US009878513B2

(12) United States Patent
Lu et al.

(10) Patent No.: US 9,878,513 B2
(45) Date of Patent: Jan. 30, 2018

(54) DECORATIVE MATERIAL ROLLING MILL HAVING ADJUSTABLE ROLL GAP

(71) Applicants: Hailin Lu, Shanghai (CN); Jiahua Zhang, Shanghai (CN)

(72) Inventors: Hailin Lu, Shanghai (CN); Jiahua Zhang, Shanghai (CN)

(73) Assignee: SHANGHAI YINSHENG RUBBER & PLASTIC COMPANY LTD., Shanghai (CN)

( * ) Notice: Subject to any disclaimer, the term of this patent is extended or adjusted under 35 U.S.C. 154(b) by 242 days.

(21) Appl. No.: 14/346,650

(22) PCT Filed: Sep. 21, 2012

(86) PCT No.: PCT/CN2012/001292

§ 371 (c)(1),
(2) Date: Mar. 21, 2014

(87) PCT Pub. No.: WO2013/040864

PCT Pub. Date: Mar. 28, 2013

(65) Prior Publication Data

US 2014/0283697 A1 Sep. 25, 2014

(30) Foreign Application Priority Data

Sep. 23, 2011 (CN) ..... 2011 1 0287244
Sep. 23, 2011 (CN) ..... 2011 2 0360880

(51) Int. Cl.
*B31F 1/07* (2006.01)
*B44B 5/00* (2006.01)

(52) U.S. Cl.
CPC ..... *B31F 1/07* (2013.01); *B44B 5/0047* (2013.01); *B31F 2201/0753* (2013.01); *B31F 2201/0776* (2013.01)

(58) Field of Classification Search
CPC ..... B41F 3/56; B41F 3/54; B41F 3/48; B41F 3/51; B41F 3/80; B31F 2201/0753; B31F 2201/0776; B31F 5/0047
See application file for complete search history.

(56) References Cited

U.S. PATENT DOCUMENTS 2,635,492 A * 4/1953 Gettig ..... B21B 25/06 29/252
3,162,077 A * 12/1964 Brummer ..... B29C 51/24 425/302.1

(Continued)

FOREIGN PATENT DOCUMENTS

JP 06292496 A * 10/1994
JP 2004267025 A * 9/2004

*Primary Examiner* — David Banh
(74) *Attorney, Agent, or Firm* — John P. White; Cooper & Dunham LLP

(57) ABSTRACT

The present invention discloses a decorative material rolling mill having an adjustable roll gap, which includes: a left frame and a right frame connected to each other; and an upper roll and a lower roll, two ends thereof being axially disposed on the left frame and the right frame; and a driving mechanism for driving the upper roll and the lower roll to rotate; and further includes: a rolling gap adjustment mechanism for driving the upper roll or the lower roll to move vertically along the left frame and the right frame, thereby adjusting a rolling gap between the upper roll and the lower roll according to the thickness of a shearing die. The present invention uses a rolling gap adjustment mechanism to adjust a rolling gap between an upper roll and a lower roll, thereby accommodating thickness differences among die sheets, upper rolling plates, and lower rolling plates from different manufacturers. Various rolling gap adjustment mechanisms disclosed by the present invention are simple in structure and convenient to use.

17 Claims, 12 Drawing Sheets

(56) References Cited

U.S. PATENT DOCUMENTS

| | | | | | |
|---|---|---|---|---|---|
| 3,199,390 | A * | 8/1965 | Arnould | B26D 7/2628 | 100/160 |
| 3,720,126 | A * | 3/1973 | Kranz | B31B 1/24 | 83/344 |
| 3,776,014 | A * | 12/1973 | Artz | B21B 13/005 | 72/240 |
| 4,112,127 | A * | 9/1978 | Popeil | A21C 9/066 | 426/283 |
| 4,182,003 | A * | 1/1980 | Lamartino | A22C 7/00 | 425/556 |
| 4,187,581 | A * | 2/1980 | Wagner | A22C 7/00 | 425/256 |
| 5,388,490 | A * | 2/1995 | Buck | B26D 7/2628 | 83/344 |
| 6,076,230 | A * | 6/2000 | Harsh | A47L 5/34 | 15/354 |
| 6,533,154 | B2 * | 3/2003 | Kitai | B65H 20/02 | 226/177 |

* cited by examiner

DECORATIVE MATERIAL ROLLING MILL HAVING ADJUSTABLE ROLL GAP

CROSS-REFERENCE TO RELATED APPLICATIONS

This application is a §371 national stage of PCT International Application No. PCT/CN2012/001292, filed Sep. 21, 2012, claiming priority of Chinese Patent Applications Nos. 201110287244.9, filed Sep. 23, 2011 and 201120360880.5, filed Sep. 23, 2011, the contents of each of which are hereby incorporated by reference in their entirety.

BACKGROUND

Technical Field

The present invention relates to the technical field of rolling equipment for fabric crafts and paper crafts, and more particularly to a decorative material rolling mill having an adjustable roll gap.

Related Art

Currently, rolling mills having fixed roll spaces are used home and abroad for fabric crafts and paper crafts. To use die sheets of different thicknesses for shearing and use knurling dies of different thicknesses for knurling, rolling plates of different thicknesses require to be equipped to meet sizes specified by roll spaces of rolling mills, and rolling plates of corresponding thicknesses require to be replaced, which increases the complexity of the process. In addition, rolling mills having fixed roll spaces cannot accommodate thickness differences among die sheets and knurling dies from different manufacturers precisely, making operations inconvenient.

SUMMARY

The technical problem to be solved by the present invention is to provide a rolling mill having an adjustable roll gap through manual shifting and a rolling mill having an automatically adjustable roll gap using a thickness measuring probe for existing deficiencies in rolling mills for existing handicrafts such as fabric crafts and paper crafts.

The technical problem to be solved by the present invention is solved through the following technical solutions:

A decorative material rolling mill having an adjustable roll gap includes:

- a left frame and a right frame connected to each other; and
- an upper roll and a lower roll, two ends thereof being axially disposed on the left frame and the right frame; and
- a driving mechanism for driving the upper roll and the lower roll to rotate; and The further includes: a rolling gap adjustment mechanism for driving the upper roll or the lower roll to move vertically along the left frame and the right frame, thereby adjusting a rolling gap between the upper roll and the lower roll according to the thickness of a shearing die.

In a preferred embodiment of the present invention, the two ends of the upper roll or the lower roll are disposed on the left frame and the right frame through sliding blocks, and the rolling gap adjustment mechanism drives the sliding blocks to move vertically along the left frame and the right frame.

In a preferred embodiment of the present invention, the driving mechanism includes: a driving small gear axially disposed on the left frame or the right frame through a driving handle shaft, a large gear located at the same side as the driving small gear and axially disposed on a shaft end at one side of the upper roll or the lower roll, and a transmission gear set axially disposed on a shaft end at a random side of the upper roll and the lower roll; and a crank handle is arranged on the driving handle shaft.

In a preferred embodiment of the present invention, the rolling gap adjustment mechanism includes:

- slope block protruding openings arranged at upper portions or lower portions of the left frame and the right frame;
- passive slopes arranged at top portions or bottom portions of the sliding blocks at the two ends of the upper roll or the lower roll;
- a guide rail plate connected between top portions or bottom portions of the left frame and the right frame;
- a dual-joint slope block arranged on a bottom surface or a top surface of the guide rail plate and horizontally movable along the guide rail plate, two ends of the dual-joint slope block protruding from the slope block protruding openings at the upper portions or the lower portions of the left frame and the right frame; active slopes fitting the passive slopes at the top portions or the bottom portions of the sliding blocks at the two ends of the upper roll or the lower roll being arranged on bottom surfaces or top surfaces of the two ends of the dual-joint slope block, where the dual-joint slope block and the guide rail plate form a first movement set, and the active slopes and the passive slopes form second movement sets; and
- a movement handle arranged on the dual-joint slope block.

In a preferred embodiment of the present invention, a guide rail groove is arranged on the guide rail plate along the length direction of the guide rail plate; a sliding key and a pair of trench plates are arranged inside the guide rail groove, the sliding key is connected to the dual-joint slope block, the pair of trench plates is arranged at two sides of the sliding key; a radial positioning hole is provided on the sliding key, a pair of positioning steel balls and a positioning spring are arranged inside the radial positioning hole, the positioning spring is arranged between the pair of steel balls; several positioning trenches or positioning holes are provided at an interval on one trench plate, and one positioning steel ball is pressed inside one random positioning trench or positioning hole under the effect of the positioning spring, so as to position the dual-joint slope block.

In a preferred embodiment of the present invention, horizontal stops are disposed at middle portions of the left frame and the right frame, and sliding block reset springs are disposed between bottom surfaces or top surfaces of the sliding blocks and the horizontal stops.

In a preferred embodiment of the present invention, the active slopes and the passive slopes are both stepped slopes.

In a preferred embodiment of the present invention, the active slope and the passive slopes connected in a slideable manner by adopting a structure of a T-shaped groove and a T-shaped guide rail being inserted to each other.

In a preferred embodiment of the present invention, a screw hole is provided at the left end or the right end of the dual joint slope block, a bolt support portion is disposed on the left frame or the right frame, a radially rotatable but axially-constrained screw rod is arranged on the bolt support portion, and the screw rod is screwed inside the screw hole.

In a preferred embodiment of the present invention, the rolling gap adjustment mechanism includes:

- a pair of cams disposed inside the upper portions or the lower portions of the left frame and the right frame, the pair of cams contacting top portions or the bottom portions of the sliding blocks at the two ends of the upper roll or the lower roll;

a cam shaft connecting the pair of cams, the cam shaft being axially supported on the left frame or the right frame and extending from the left frame or the right frame;

a crank handle arranged on a shaft end of the cam shaft extending from the left frame or the right frame; and horizontal stops disposed at middle portions of the left frame and the right frame, sliding block reset springs being disposed between bottom surfaces or top surfaces of the sliding blocks and the horizontal stops.

In a preferred embodiment of the present invention, the rolling gap adjustment mechanism includes:

screw holes arranged inside the sliding blocks at the two ends of the upper roll or the lower roll;

a screw rod screwed in each screw hole, a worm gear being arranged in each screw rod;

a dual-joint worm axially disposed on the left frame and the right frame, worm segments being synchronously engaged with two worm gears being disposed on the dual-joint worm; and one end of the dual-joint worm extending from the left frame or the right frame; and a crank handle arranged on a shaft end of the dual-joint worm extending from the left frame or the right frame.

In a preferred embodiment of the present invention, the rolling gap adjustment mechanism includes:

frame slopes arranged inside top portions of the left frame and the right frame;

upper connecting plates fixed on the top portions of the left frame and the right frame;

positioning guide rails fixed at middle positions of the upper connecting plates, inclined angles of the positioning guide rails being consistent with angles of the frame slopes;

guide rail cover plates fixed at two ends of the positioning guide rails;

a dual-joint slope block, two ends of the dual-joint slope block extending between the top surfaces of the sliding blocks at the two ends of the upper roll and the frame slopes, passive slopes fitting the frame slopes being arranged at top portions of the two ends of the dual-joint slope block, the frame slopes and the passive slopes forming movement sets, sliding block acting portions being arranged at bottom portions of two ends of the dual joint slope block, and the sliding block acting portions acting on the sliding blocks;

a positioning sliding block inserted inside the positioning guide rails being fixedly disposed at a middle position of the dual-joint slope block, one end of the positioning sliding block coming out from one guide rail cover plate, and a positioning guide rail reset spring being arranged between the other end of the positioning sliding block and the other guide rail cover plate; and a probe installed on the part of the positioning sliding block coming out from the guide rail cover plate through a radial fixation screw and an axial adjustment screw, the probe being located above a rolling workbench.

In a preferred embodiment of the present invention, the left frame is formed of a left front support and a left rear support, and right frame is formed of a right front support and a right rear support.

In a preferred implementation of the present invention, the left front support, the left rear support, the right front support, and the right rear support are formed by adopting a casting forming method along an aperture.

By adopting the foregoing technical solutions, the present invention uses a rolling gap adjustment mechanism to adjust a rolling gap between an upper roll and a lower roll, thereby accommodating thickness differences among die sheets, upper rolling plates, and lower rolling plates from different manufacturers. Various rolling gap adjustment mechanisms disclosed by the present invention are simple in structure and convenient to use.

BRIEF DESCRIPTION OF THE DRAWINGS

The present disclosure will become more fully understood from the detailed description given herein below for illustration only, and thus are not limitative of the present disclosure, and wherein.

DETAILED DESCRIPTION

Figure 1:
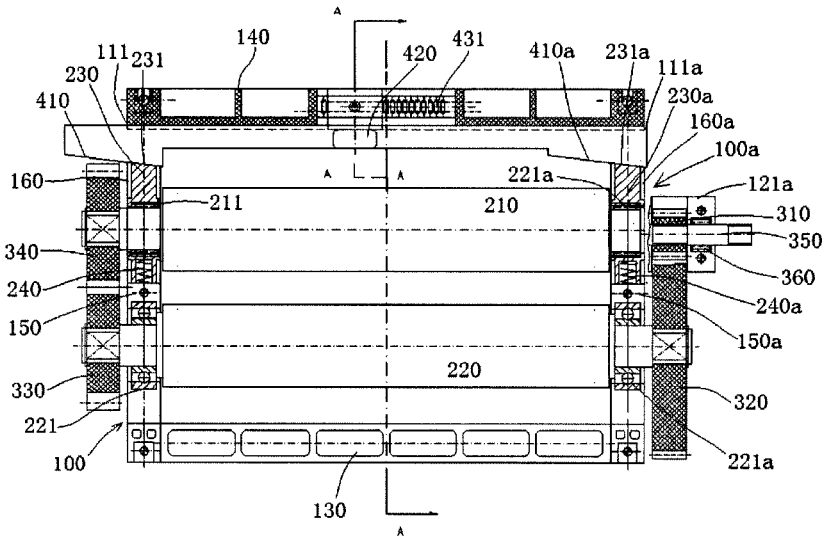
FIG. 1 is a schematic structural view of Embodiment 1 of the present invention.
Figure 2:
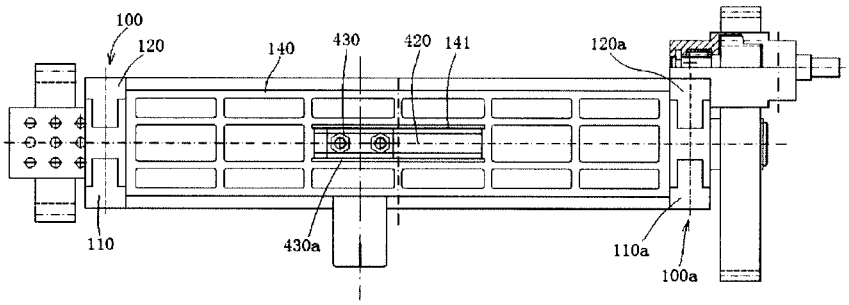
FIG. 2 is a top view of FIG. 1.
Figure 3:
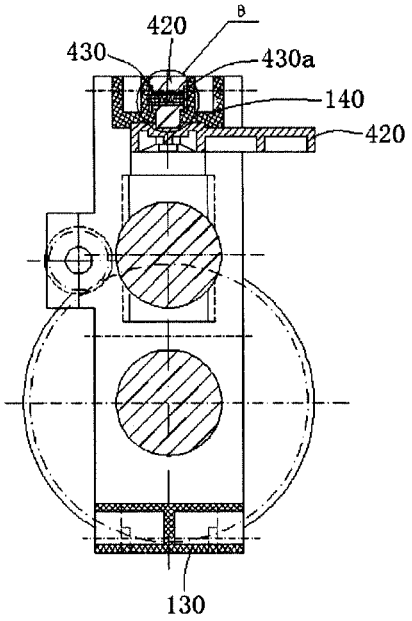
FIG. 3 is a view along A-A in FIG. 1.
Figure 4:
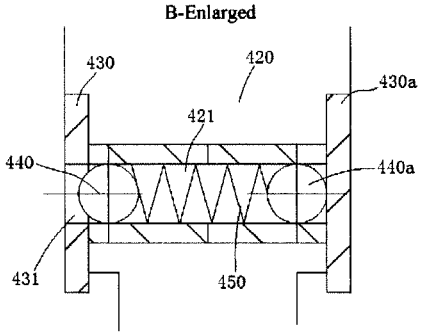
FIG. 4 is an enlarged schematic view of B in FIG. 3.

The present invention is further described below with reference to the accompanying drawings and specific implementation manners.

Embodiment 1

Refer to FIG. 1 to FIG. 4. A decorative material rolling mill having an adjustable roll gap shown in the drawings includes a left frame 100 and a right frame 100*a*. The left frame 100 is formed of a left front support 110 and a left rear support 120. The right frame 100*a* is formed of a right front support 110*a* and a right rear support 120*a*.

Bottom portions of the left frame 100 and the right frame 100*a* are connected through a lower connecting plate 130. In connecting, the lower connecting plate 130 further connects the left front support 110 and the left rear support 120 and connects the right front support 110*a* and the right rear support 120*a* through a fastening bolt.

Top portions of the left frame 100 and the right frame 100*a* are connected through a guide rail plate 140. In connecting, the guide rail plate 140 further connects the left front support 110 and the left rear support 120 and connects the right front support 110*a* and the right rear support 120*a* through a fastening bolt.

When being connected adopting the foregoing manner, the left frame 100, the right frame 100*a*, the lower connecting plate 130, and the guide rail plate 140 form a rectangular frame.

The decorative material rolling mill having an adjustable roll gap depends on a pair of rolls to work. The pair of rolls includes an upper roll 210 and a lower roll 220. The lower roll 220 is supported on lower portions of the left frame 100 and the right frame 100*a* through a pair of ball bearings 221, 221*a*, that is, supported on lower portions of the left front support 110 and the left rear support 120 and lower portions of the right front support 110*a* and the right rear support 120*a*.

A left horizontal stop 150 is connected between middle portions of the left front support 110 and the left rear support 120. A right horizontal stop 150*a* is connected between middle portions of the right front support 110*a* and the right rear support 120*a*. A sliding cavity 160 for a sliding block to slide vertically is formed in the space located above the horizontal stop 150 of the left front support 110 and the left rear support 120. A sliding cavity 160*a* for a sliding block to slide vertically is formed in the space located above the horizontal stop 150*a* of the right front support 110*a* and the right rear support 120*a*.

Sliding blocks 230, 230*a* are placed inside the sliding cavities 160, 160*a*, respectively. Sliding block reset springs 240, 240*a* are disposed between bottom surfaces of sliding blocks 230 and 230*a* and the horizontal stops 150, 150*a*. Top surfaces of the sliding blocks 230, 230*a* are passive slopes 231, 231*a* with the same inclined angle and parallel to each other.

Two ends of the upper roll 210 are supported on the sliding blocks 230, 230*a* through needle roller bearings 211, 211*a*, respectively.

The rotation of the upper roll 210 and the lower roll 220 depends on a driving mechanism. The driving mechanism includes a small gear 310, a large gear 320, an active gear 330, and a passive gear 340. The active gear 330 and the passive gear 340 are installed on left shaft ends of the lower roll 220 and the upper roll 210, respectively, and are engaged with each other. The large gear 320 is installed on a right shaft end of the lower roll 220.

A protruding handle shaft bearing seat 121*a* is disposed on the right front support 120*a*. A handle shaft 350 is supported on the handle shaft bearing seat 121*a* through a needle roller bearing 360. A bearing cover (not shown) is installed on the handle shaft bearing seat 121*a* through a fastening screw. The small gear 310 is disposed at an inner end of the handle shaft 350 through a key. A crank handle (not shown) is installed at an inner end of the handle shaft 350. The crank handle rotates to drive the handle shaft 350 to rotate. Also, the crank handle drives the small gear 310 to rotate. Through the engagement between the small gear 310 and the large gear 320, the small gear 310 drives the large gear 320 to rotate at a lower speed. The rotation of the large gear 320 also drives the lower roll 220 to rotate. The lower roll 220 rotates to further drive the active gear 330 to rotate. The upper roll 210 is driven to rotate through a transmission set formed of the active gear 330 and the passive gear 340 being engaged with each other. Rolling is accomplished with the rotation of the upper roll 210 and the lower roll 220.

To accommodate thickness differences among die sheets and knurling dies from different manufacturers, this embodiment uses a rolling gap adjustment mechanism to adjust the rolling gap between the upper roll 210 and the lower roll 220.

The rolling gap adjustment mechanism in the embodiment includes a dual-joint slope block 400 installed on a bottom portion of the guide rail plate 140. The dual-joint slope block 400 and the guide rail plate 140 form a first movement set, and slope block protruding openings 111, 111*a* are provided at upper portions of the left frame 100 and the right frame 100*a*. When the dual-joint slope block 400 moves horizontally along the guide rail plate 140, two ends of the dual-joint slope block 400 can extend from the slope block protruding openings 111, 111*a*.

Active slopes 410, 410*a* fitting passive slopes 231, 231*a* of the sliding blocks 230, 230*a* are arranged on bottom surfaces of the two ends of the dual-joint slope block 400. The active slopes 410, 410*a* and the passive slopes 231, 231*a* form second movement sets. Further, a movement handle 420 is disposed on the dual-joint slope block 400. By means of the movement handle 420, the dual-joint slope block 400 can move horizontally. Through the second movement sets formed of the active slopes 410, 410*a* and the passive slopes 231, 231*a*, the horizontal movement of the dual-joint slope block 400 is converted into vertical movement of the sliding blocks 230, 230*a*. The vertical movement of the sliding blocks 230, 230*a* drives the upper roll 210 to move vertically relative to the lower roll 220, so as to adjust the rolling gap between the upper roll 210 and the lower roll 220.

To perform shift adjustment for the rolling gap between the upper roll 210 and the lower roll 220, in this embodiment, a guide rail groove 141 arranged along the length direction of the guide rail plate 140 is provided on the guide rail plate 140. A sliding key 420 and a pair of trench plates 430, 430*a* are arranged inside the guide rail groove 141. The sliding key 420 is connected to the dual-joint slope block 400. The pair of trench plates 430, 430*a* is arranged at two sides of the sliding key 420.

A radial positioning hole 421 is provided on the sliding key 420. A pair of positioning steel balls 440, 440*a* and a positioning spring 450 are arranged inside the radial positioning hole 421. The positioning spring 450 is arranged between the pair of steel balls 440, 440*a*. Several positioning trenches 431 are provided at an interval on the trench plate 430 (certainly several positioning holes may also be provided), so as to form a plurality of shifts. The adjustment amount of the rolling gap between the upper roll 210 and the lower roll 220 each time depends on the space between two adjacent positioning trenches 431.

When the sliding key 420 moves, the positioning steel ball 440 is pressed into one random positioning trench 431 under the effect of the positioning spring 450, so as to position the dual-joint slope block 400, thereby ensuring the stability of the dual-joint slope block 400 at a new position and ensuring desirable handgrip of the dual-joint slope block 400 in the movement process.

Figure 5:
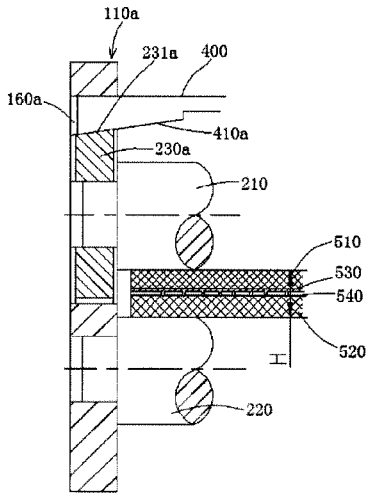
FIG. 5 is a schematic view of a work state when a rolling gap between an upper roll and a lower roll is minimal according to Embodiment 1 of the present invention.

The working principle of the foregoing rolling gap adjustment mechanism is as follows: Refer to FIG. 5. When the dual-joint slope block 400 moves to the left to a limit position, the active slope 410*a* at the left end of the dual joint slope block 400 fits the passive slope 231*a* of the sliding block 230*a*, so as to press the sliding block 230*a* to the lowest position. Also, the active slope 410 at the right end of the dual-joint slope block 400 fits the passive slope 231 of the sliding block 230, so as to press the sliding block 230 to the lowest position. At this time, the rolling gap H between the upper roll 210 and the lower roll 220 becomes minimal. An upper rolling plate 510, a lower rolling plate 520, a die sheet 530, and a paper craft card 540 are stacked to pass between the upper roll 210 and the lower roll 220, so that the die sheet 530 presses a pattern on a paper craft card 540.

Figure 6:
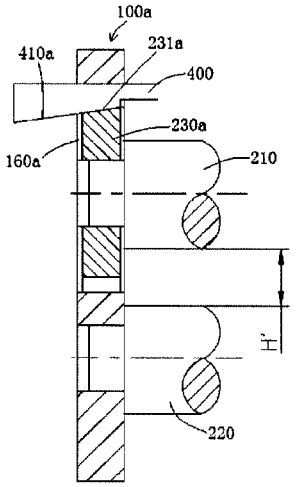
FIG. 6 is a schematic view of a work state when a rolling gap between an upper roll and a lower roll is maximal according to Embodiment 1 of the present invention.

Refer to FIG. 6. When the dual-joint slope block 400 moves to the right to a limit position, the active slope 410*a* at the left end of the dual-joint slope block 400 leaves the passive slope 231*a* of the sliding block 230*a*. The sliding block 230*a* rises to the highest position on the sliding block reset spring. Also, the active slope 410 at the left end of the dual joint slope block 400 leaves the passive slope 231 of the sliding block 230. The sliding block 230 rises to the highest position on the sliding block reset spring. At this time, the rolling gap H' between the upper roll 210 and the lower roll 220 becomes maximal.

Embodiment 2

Figure 7:
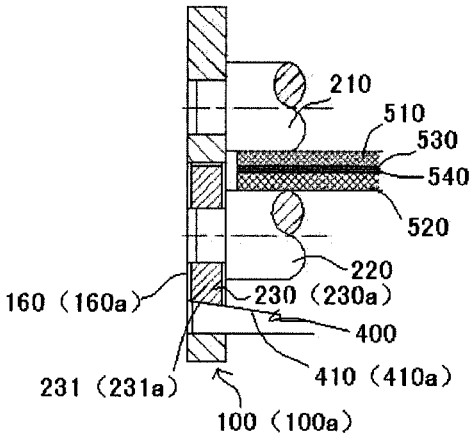
FIG. 7 is a schematic view of a work state when a rolling gap between an upper roll and a lower roll is minimal according to Embodiment 2 of the present invention.
Figure 8:
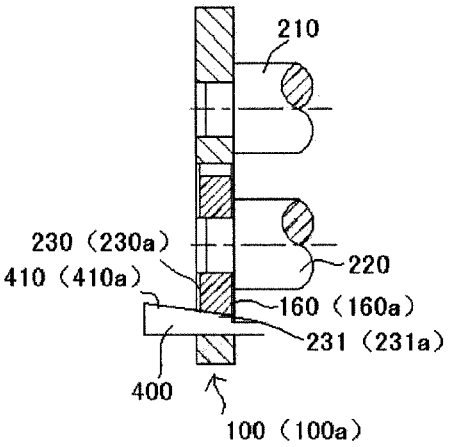
FIG. 8 is a schematic view of a work state when a rolling gap between an upper roll and a lower roll is maximal according to Embodiment 2 of the present invention.

Refer to FIG. 7 and FIG. 8. In this embodiment, the guide rail plate is installed at bottom portions of the left frame 100 and the right frame 100*a*. The dual-joint slope block 400 is installed on the top surface of the guide rail plate. A sliding cavity 160 for the sliding blocks 230 to slide vertically is formed in the space located below the horizontal stop of the left front support and the left rear support. A sliding cavity for the sliding block 230*a* to slide vertically is formed in the space located below the horizontal stop of the right front support and the right rear support. The two ends of the lower roll 220 are supported on the sliding blocks 230, 230*a* through needle roller bearings, respectively. The upper roll 220 is supported on the upper portions of the left frame 100 and the right frame 100*a* through a pair of ball bearings, that is, supported on the upper portions of the left front support and the left rear support and on the upper portions of the right front support and the right rear support.

Sliding block reset springs are disposed between top surfaces of the sliding blocks 230, 230*a* and the horizontal stop. The bottom surfaces of the sliding blocks 230, 230*a* are passive slopes 231, 231*a* with the same inclined angle and parallel to each other. Active slopes 410, 410*a* fitting the passive slopes 231, 231*a* of the sliding blocks 230, 230*a* are arranged on the top surfaces of the two ends of the dual-joint slope block 400. The working principle is basically the same as that in Embodiment 1.

Embodiment 3

Figure 9:
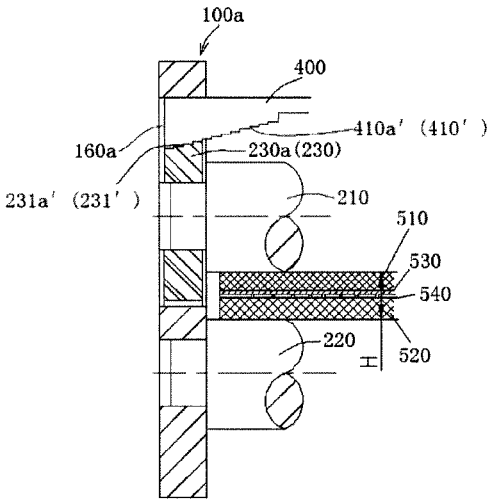
FIG. 9 is a schematic view of a work state when a rolling gap between an upper roll and a lower roll is minimal according to Embodiment 3 of the present invention.
Figure 10:
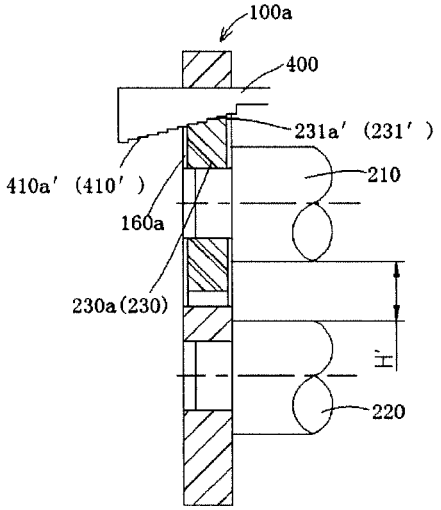
FIG. 10 is a schematic view of a work state when a rolling gap between an upper roll and a lower roll is maximal according to Embodiment 3 of the present invention.

This embodiment is basically the same as Embodiment 1. Refer to FIG. 9 and FIG. 10. The passive slopes 231, 231*a* of the sliding blocks 230, 230*a* are changed to stepped passive slopes 231', 231*a*', and the active slopes 410, 410*a* at two ends of the dual-joint slope block 400 are changed to stepped active slopes 410', 410*a'*.

Refer to FIG. 9. When the dual-joint slope block 400 moves to the left to a limit position, the stepped active slope 410*a*' at the left end of the dual-joint slope block 400 fits the stepped passive slope 231*a*' of the sliding block 230*a*, so as to press the sliding block 230*a* to the lowest position. Also, the stepped active slope 410 at the right end of the dual-joint slope block 400 fits the stepped passive slope 231' of the sliding block 230, so as to press the sliding block 230 to the lowest position. At this time, the rolling gap H between the upper roll 210 and the lower roll 220 becomes minimal. The upper rolling plate 510, the lower rolling plate 520, the die sheet 530, and the paper craft card 540 are stacked to pass between the upper roll 210 and the lower roll 220, so that the die sheet 530 presses a pattern on the paper craft card 540.

Refer to FIG. 10. When the dual-joint slope block 400 moves to the right to a limit position, the stepped active slope 410*a*' at the left end of the dual-joint slope block 400 leaves the stepped passive slope 231*a*' of the sliding block 230*a*, the sliding block 230*a* rises to the highest position on the sliding block reset spring. Also, the stepped active slope 410' at the left end of the dual-joint slope block 400 leaves the stepped passive slope 231' of the sliding block 230. The sliding block 230 rises to the highest position on the sliding block reset spring. At this time, the rolling gap H' between the upper roll 210 and the lower roll 220 becomes maximal.

Embodiment 4

Figure 11:
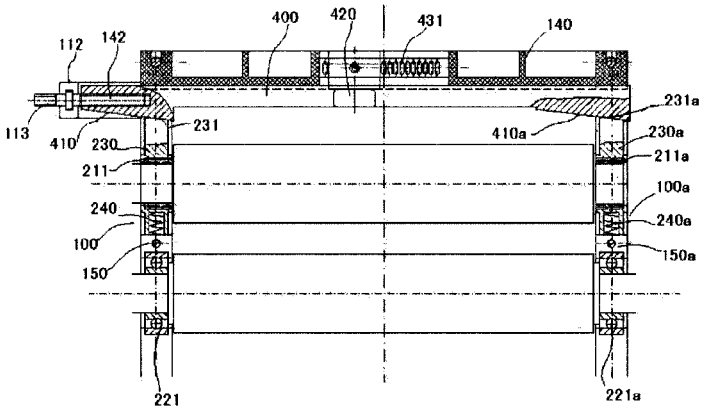
FIG. 11 is a schematic structural view of Embodiment 4 of the present invention.

This embodiment and Embodiment 1 are basically the same in structure. This embodiment is different from Embodiment 1 in that: Refer to FIG. 11. A screw hole 142 is provided at the left end of the dual-joint slope block 140. A bolt support portion 112 is disposed on the left frame 100. A radially rotatable but axially-constrained screw rod 113 is arranged on the bolt support portion 112. The screw rod 113 is screwed inside the screw hole 142. The screw rod 113 rotates to drive the dual-joint slope block 140 to move horizontally, so as to drive the sliding blocks 230, 230*a* to move vertically, thereby adjusting the rolling gap between the upper roll 210 and the lower roll 220.

Embodiment 5

Figure 12:
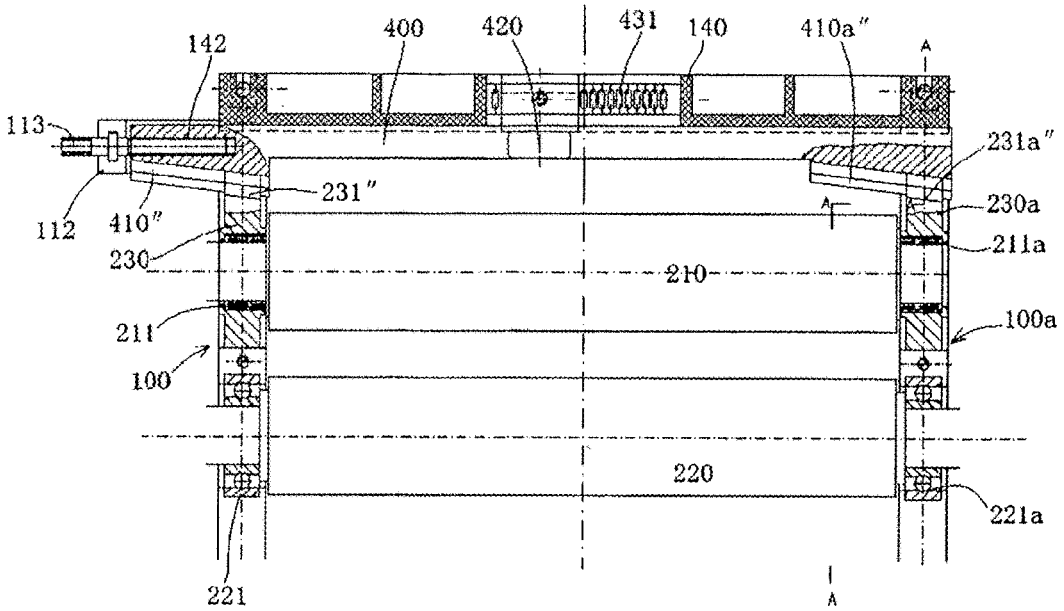
FIG. 12 is a schematic structural view of Embodiment 5 of the present invention.
Figure 13:
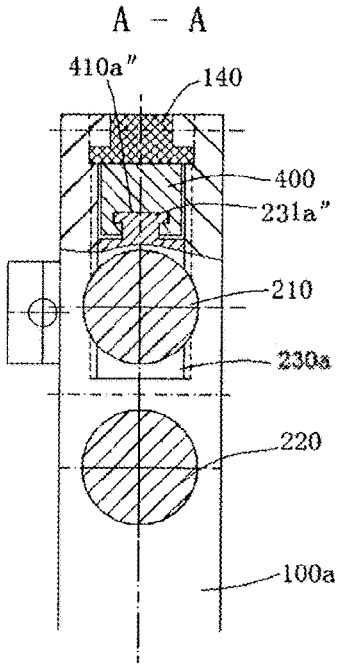
FIG. 13 is a view along A-A in FIG. 12.

This embodiment is basically the same as Embodiment 1 in structure. This embodiment is different from Embodiment 1 in that: Refer to FIG. 12 and FIG. 13, the sliding block reset springs 240, 240*a* are omitted, and the passive slopes 231, 231*a* of the sliding blocks 230, 230*a* are changed to T-shaped guide rail passive slopes 231", 231*a*", the active slopes 410, 410*a* at two ends of the dual-joint slope block 400 are changed to T-shaped groove active slopes 410", 410*a*". The T-shaped guide rail passive slopes 231", 231*a*" are inserted in the T-shaped groove active slopes 410", 410*a*", respectively.

In addition, a screw hole 142 is provided at the left end of the dual-joint slope block 140. A bolt support portion 112 is disposed on the left frame 100. A radially rotatable but axially-constrained screw rod 113 is arranged on the bolt support portion 112. The screw rod 113 is screwed inside the screw hole 142. The screw rod 113 rotates to drive the dual-joint slope block 140 to move horizontally, so as to drive the sliding blocks 230, 230*a* to move vertically, thereby adjusting the rolling gap between the upper roll 210 and the lower roll 220.

Embodiment 6

Figure 14:
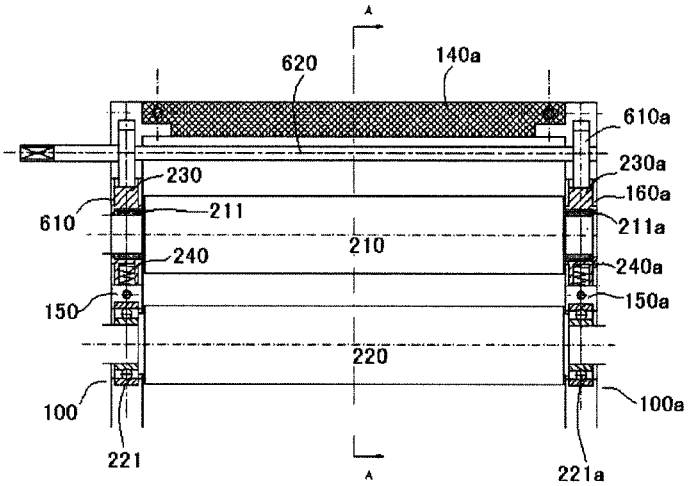
FIG. 14 is a schematic structural view of Embodiment 6 of the present invention.
Figure 15:
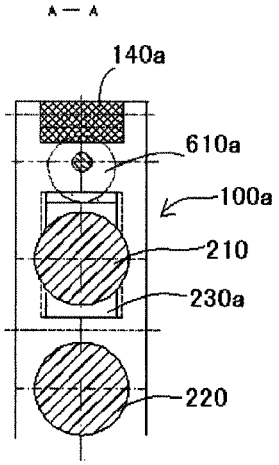
FIG. 15 is a view along A-A in FIG. 14.

This embodiment is different from Embodiment 1 in the rolling gap adjustment mechanism. Refer to FIG. 14 and FIG. 15. The rolling gap adjustment mechanism is formed by adopting a pair of cams 610, 610*a* and a cam shaft 620. The top surfaces of the sliding blocks 230, 230*a* are planes.

The top portions of the left frame 100 and the right frame 100*a* are connected through an upper connecting plate 140*a*. The decorative material rolling mill having an adjustable roll gap depends on a pair of rolls to work. The pair of rolls includes an upper roll 210 and a lower roll 220. The lower roll 220 is supported on the lower portions of the left frame 100 and the right frame 100*a* through a pair of ball bearings 221, 221*a*.

A left horizontal stop 150 is disposed at the middle portion of the left support 100. A right horizontal stop 150*a* is disposed at the middle portion of the right support 100*a*. A sliding cavity 160 for the sliding block to slide vertically is formed in the space located above the horizontal stop 150 of the left support 100. A sliding cavity 160*a* for the sliding block to slide vertically is formed in the space located above the horizontal stop 150*a* of the right support 100*a*.

Sliding blocks 230, 230*a* are placed inside the sliding cavities 160, 160*a*, respectively. Sliding block reset springs 240, 240*a* are disposed between the bottom surfaces of the sliding blocks 230, 230*a* and the horizontal stops 150, 150*a*. The top surfaces of the sliding blocks 230, 230*a* are planes.

The two ends of the upper roll 210 are supported on the sliding blocks 230, 230*a* through needle roller bearings 211, 211*a*, respectively.

A pair of cams 610, 610*a* is arranged inside the sliding cavities 160, 160*a* and contacts the top surfaces of the sliding blocks 230, 230*a*. A cam shaft 620 is axially supported on the left frame 100 and extends from the left frame 100. Two ends of the cam shaft 620 and the pair of cams 610, 610*a* are connected through a key. A crank handle (not shown) is arranged on the shaft end of the cam shaft extending from the left frame 100.

The crank handle rotates to drive the cam shaft 620 to rotate. The pair of cams 610, 610*a* acts on the sliding blocks 230, 230*a*, respectively, to drive the sliding blocks 230, 230*a* to move downward. The upward movement of the sliding blocks 230, 230*a* is implemented depending on the sliding block reset springs 240, 240*a*. The rest structures of this embodiment are the same as those in Embodiment 1. The working principle of rolling is also the same as that in Embodiment 1.

Embodiment 7

Figure 16:
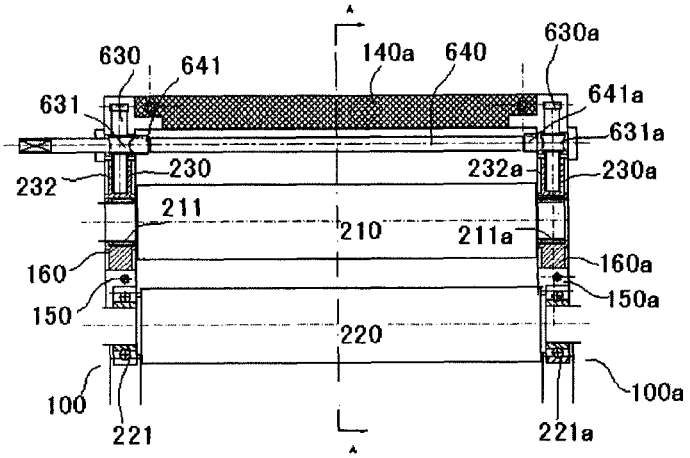
FIG. 16 is a schematic structural view of Embodiment 6 of the present invention.
Figure 17:
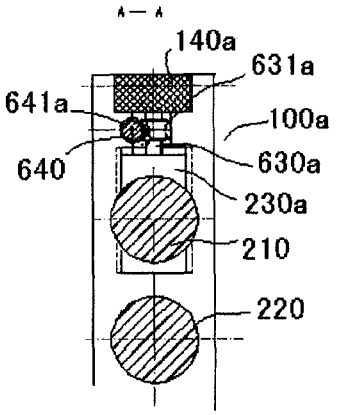
FIG. 17 is a view along A-A in FIG. 16.
Figure 18:
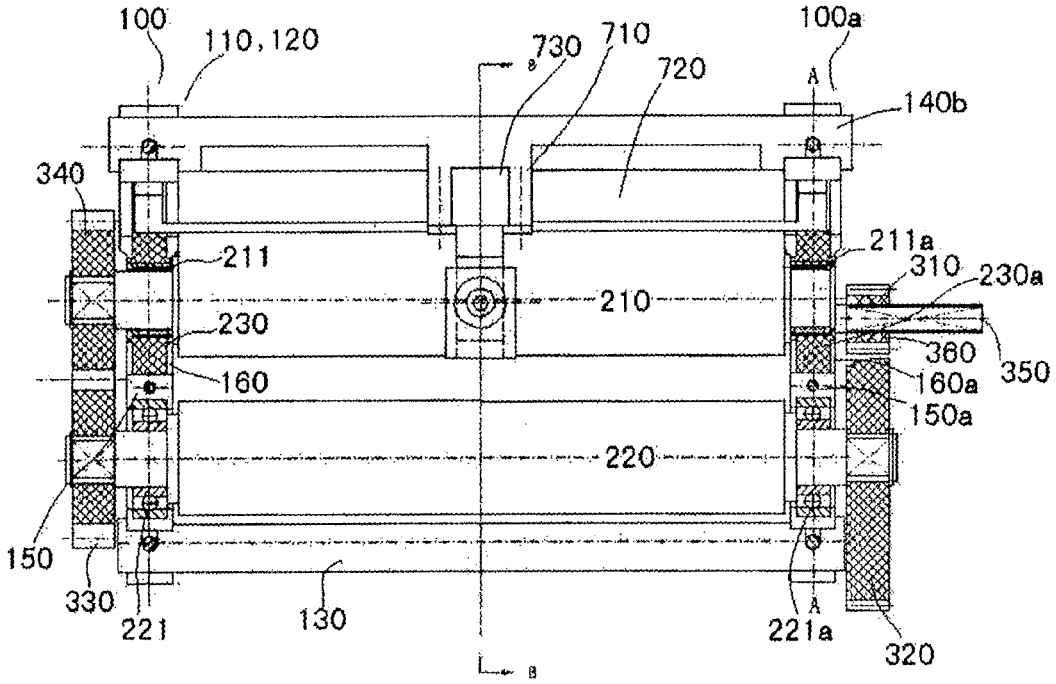
FIG. 18 is a schematic structural view of Embodiment 7 of the present invention.
Figure 19:
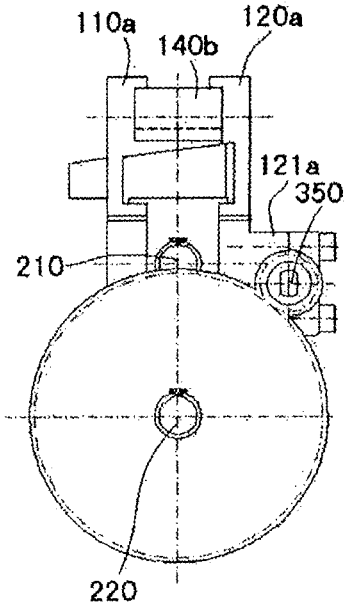
FIG. 19 is a left view of FIG. 18.
Figure 20:
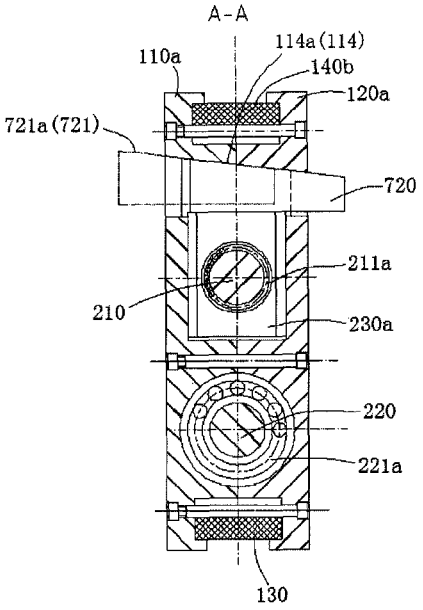
FIG. 20 is a sectional view along A-A in FIG. 18.
Figure 21:
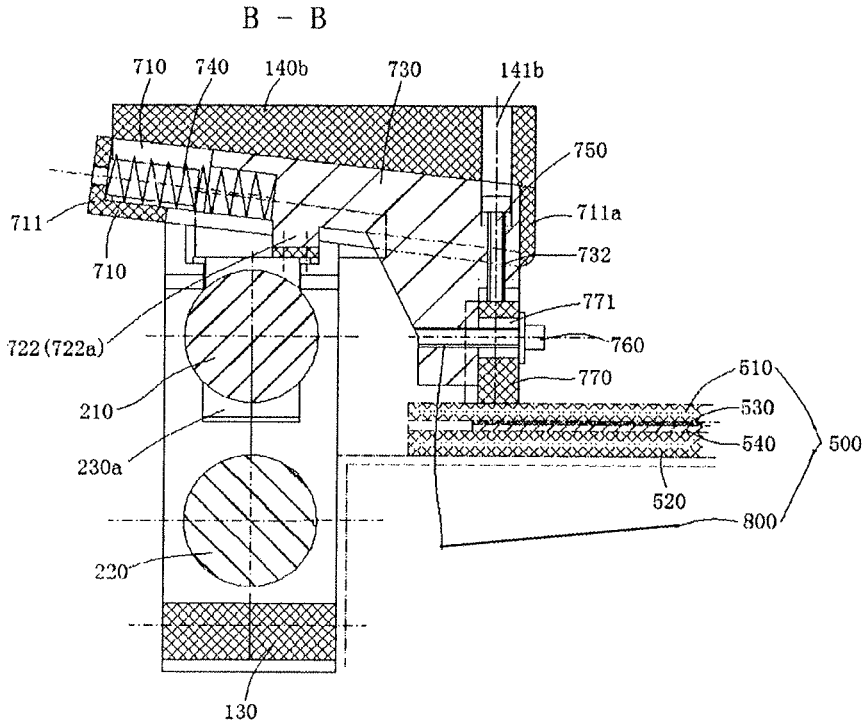
FIG. 21 is a sectional view along B-B in FIG. 18.

This embodiment is different from Embodiment 1 in the rolling gap adjustment mechanism. Refer to FIG. 16 and FIG. 17. The rolling gap adjustment mechanism is formed by adopting a pair of screw rods 630, 630*a*, worm gears 631, 631*a* arranged on the pair of screw rods 630, 630*a*, and a dual-joint worm 640. Also, the sliding block reset springs 240, 240*a* are omitted, and screw holes 232, 232*a* are provided on the sliding blocks 230, 230*a*.

The top portions of the left frame 100 and the right frame 100*a* are connected through an upper connecting plate 140*a*. The decorative material rolling mill having an adjustable roll gap depends on a pair of rolls to work. The pair of rolls includes an upper roll 210 and a lower roll 220. The lower roll 220 is supported on the lower portions of the left frame 100 and right frame 100*a* through a pair of ball bearings 221, 221*a*.

A left horizontal stop 150 is disposed at the middle portion of the left support 100. A right horizontal stop 150*a* is disposed at the middle portion of the right support 100*a*. A sliding cavity 160 for the sliding block to slide vertically is formed in the space located above the horizontal stop 150 of the left support 100. A sliding cavity 160*a* for the sliding block to slide vertically is formed in the space located above the horizontal stop 150*a* of the right support 100*a*.

Sliding blocks 230, 230*a* are placed inside the sliding cavities 160, 160*a*, respectively. The two ends of the upper roll 210 are supported on the sliding blocks 230, 230*a* through needle roller bearings 211, 211*a*, respectively.

A pair of screw rods 630, 630*a* is arranged inside the sliding cavities 160, 160*a* and is in threaded connection to the screw holes 232, 232*a* inside the sliding blocks 230, 230*a*. The dual-joint worm 640 is axially supported on the left frame 100 and extends from the left frame 100. Worm segments 641, 641*a* are disposed at the two ends of the dual-joint worm 640. The worm segments 641, 641*a* are engaged with the worm gears 631, 631*a*, respectively. A crank handle (not shown) is arranged on the shaft end of the dual-joint worm 640 extending from the left frame 100.

The crank handle rotates to drive the dual-joint worm 640 to rotate. The rotation of the dual-joint worm 640 drives the worm segments 641, 641*a* to rotate. Through the engagement between the worm segments 641, 641*a* and the worm gears 631, 631*a*, the worm gears 631, 631*a* are driven to rotate. The worm gears 631, 631*a* then drive the screw rods 630, 630*a* to rotate. The screw rods 630, 630*a* drive the sliding blocks 230, 230*a* to move vertically to implement the adjustment of the rolling gap between the upper roll 210 and the lower roll 220. The working principle of rolling is also the same as that in Embodiment 1.

Embodiment 8

Refer to FIG. 18 to FIG. 21. The decorative material rolling mill having an adjustable roll gap given in the drawings includes a left frame 100 and a right frame 100*a*. The left frame 100 is formed of a left front support 110 and a left rear support 120. The right frame 100*a* is formed of a right front support 110*a* and a right rear support 120*a*.

Bottom portions of the left frame 100 and the right frame 100*a* are connected through a lower connecting plate 130. In connecting, the lower connecting plate 130 further connects the left front support 110 and the left rear support 120 and connects the right front support 110*a* and the right rear support 120*a* through a fastening bolt.

Top portions of the left frame 100 and the right frame 100*a* are connected through an upper connecting plate 140*b*. In connecting, the upper connecting plate 140*b* further connects the left front support 110 and the left rear support 120 and connects the right front support 110*a* and the right rear support 120*a* through a fastening bolt.

When being connected adopting the foregoing manner, the left frame 100, the right frame 100*a*, the lower connecting plate 130, and the upper connecting plate 140*b* form a rectangular frame.

The decorative material rolling mill having an adjustable roll gap depends on a pair of rolls to work. The pair of rolls includes an upper roll 210 and a lower roll 220. The lower roll 220 is supported on lower portions of the left frame 100 and the right frame 100*a* through a pair of ball bearings 221, 221*a*, that is, supported on the lower portions of the left front support 110 and the left rear support 120 and the lower portions of the right front support 110*a* and the right rear support 120*a*.

A left horizontal stop 150 is connected between middle portions of the left front support 110 and the left rear support 120. A right horizontal stop 150*a* is connected between the middle portions of the right front support 110*a* and the right rear support 120*a*. A sliding cavity 160 for the sliding block to slide vertically is formed in the space located above the horizontal stop 150 of the left front support 110 and the left rear support 120. A sliding cavity 160*a* for the sliding block to slide vertically is formed in the space located above the horizontal stop 150*a* of the right front support 110*a* and the right rear support 120*a*.

Sliding blocks 230, 230*a* are placed inside the sliding cavities 160, 160*a*, respectively, and top surfaces of the sliding blocks 230, 230*a* are planes.

Two ends of the upper roll 210 are supported on the sliding blocks 230, 230*a* through needle roller bearings 211, 211*a*, respectively.

The rotation of the upper roll 210 and the lower roll 220 depends on a driving mechanism. The driving mechanism includes a small gear 310, a large gear 320, an active gear 330, and a passive gear 340. The active gear 330 and the passive gear 340 are installed on left shaft ends of the lower roll 220 and the upper roll 210, respectively, and are engaged with each other. The large gear 320 is installed on a right shaft end of the lower roll 220.

A protruding handle shaft bearing seat 121*a* is disposed on the right front support 120*a*. The handle shaft 350 is supported on the handle shaft bearing seat 121*a* through a needle roller bearing 360. A bearing cover (not shown) is installed on the handle shaft bearing seat 121*a* through a fastening screw. The small gear 310 is disposed at an inner end of the handle shaft 350 through a key. A crank handle (not shown) is installed at an outer end of the handle shaft 350. The crank handle rotates to drive the handle shaft 350 to rotate. The crank handle also drives the small gear 310 to rotate. Through the engagement between the small gear 310 and the large gear 320, the small gear 310 drives the large gear 320 to rotate at a lower speed. The rotation of the large gear 320 also drives the lower roll 220 to rotate. The rotation of the lower roll 220 also drives the active gear 330 to rotate. The upper roll 210 is driven to rotate through a transmission set formed of the active gear 330 and the passive gear 340 being engaged with each other. Rolling is accomplished with the rotation of the upper roll 210 and the lower roll 220.

To accommodate thickness differences among die sheets and knurling dies from different manufacturers, this embodiment uses a rolling gap adjustment mechanism to adjust the rolling gap between the upper roll 210 and the lower roll 220.

The rolling gap adjustment mechanism in this embodiment includes frame slopes 114, 114*a* arranged inside top portions of the left frame 100 and the right frame 100*a* and a positioning guide rail 710 fixed at the middle position of the upper connecting plate 140*b*. The inclined angle of the positioning guide rail 710 is consistent with the angle of the frame slope. Guide rail cover plates 711, 711*a* are fixedly installed at two ends of the positioning guide rail 710.

A dual-joint slope block 720 is installed below the upper connecting plate 140*b*. Two ends of the dual-joint slope block 720 extend between top surfaces of the sliding blocks 230, 230*a* at the two ends of the upper roll 210 and the frame slopes 114, 114*a*. Passive slopes 721, 721*a* fitting the frame slopes 114, 114*a* are arranged at the top portions of the two ends of the dual-joint slope block 720. The frame slopes 114, 114*a* and the passive slopes 721, 721*a* form movement sets. Sliding block acting portions 722, 722*a* are arranged at the bottom portions of the two ends of the dual-joint slope block 720. The sliding block acting portions 722, 722*a* act on the sliding blocks 230, 230*a*.

A positioning sliding block 730 inserted inside the positioning guide rail 710 is disposed at the middle position of the dual-joint slope block 720. One end of the positioning sliding block 730 comes out from the guide rail cover plate 711*a*. A positioning guide rail reset spring 740 is arranged between the other end of the positioning sliding block 730 and the guide rail cover plate 711.

A probe 770 is installed through a radial fixation screw 760 and an axial adjustment screw 750 on the part of the positioning sliding block 730 coming from the guide rail cover plate 711*a*. The probe 770 is located above the rolling workbench 800. The specific installation manner is as follows: A radial screw hole 731 is provided on the part of the positioning sliding block 730 coming from the guide rail cover plate 711*a*. The radial fixation screw 760 passes through a waist-shaped hole 771 on the probe 770 to be screwed inside the radial screw hole 731. The object of disposing waist-shaped hole 771 is mainly to facilitate the adjustment of the height of the probe 770, and also compensate for the abrasion of the probe 770. An axial through hole 141*b* is provided on the upper connecting plate 140*b*. An axial screw hole 732 is provided on the part of the positioning sliding block 730 coming from the guide rail cover plate 711*a*. The axial adjustment screw 750 passes through the axial through hole 141*b* and is screwed through the axial screw hole 732 to press the top surface of the probe 770. The height of the probe 770 can be adjusted through the axial adjustment screw 750.

Refer to FIG. 18 to FIG. 21. First, the paper craft card 540 to be sheared is placed on the lower rolling plate 520. The die sheet 530 is placed on the paper craft card 540. The rolling plate 510 is placed on the die sheet 530 to form the shearing die 500. The shearing die 500 is pushed into the workbench 800. When the shearing die 500 is higher than the bottom portion of the probe 770, the probe 770 moves forward and upward as being pushed by the shearing die 500. The risen probe 770 pushes the positioning sliding block 730 to move upward along the positioning guide rail 710 and drives the dual-joint slope block 720 to move upward along the frame slopes 114, 114*a* inside the top portions of the left frame 100 and the right frame 100*a*, so as to produce gaps between the sliding blocks 230, 230*a* and the sliding block acting portions 722, 722*a* at the two ends of the dual-joint slope block 720. The shearing die 500 continues to move between the upper roll 210 and the lower roll 220 to push up the upper roll 210, so that the shearing die 500 goes between the upper roll 210 and the lower roll 220. The top surfaces of the sliding blocks 230, 230*a* are held against the bottom surfaces of the sliding block acting portions 722, 722*a* at the two ends of the dual-joint slope block 720.

The crank handle rotates to drive the handle shaft 350 to rotate. The crank handle also drives the small gear 310 to rotate. Through the engagement between the small gear 310 and the large gear 320, the small gear 310 drives the large gear 320 to rotate at a lower speed. The rotation of the large gear 320 also drives the lower roll 220 to rotate. The rotation of the lower roll 220 also drives the active gear 330 to rotate. The upper roll 210 is driven to rotate through a transmission set formed of the active gear 330 and the passive gear 340 being engaged with each other. The rotation of the upper roll 210 and the lower roll 220 drives the shearing die 500 to move forward to perform rolling on the part that requires rolling. When the rolling is finished, the shearing die 500 is pushed out. The positioning sliding block 730 and the probe 770 are reset through the positioning guide rail reset spring 740, so as to enter a next rolling state.

Compared with the prior art, the embodiment adopts two standardized rolling plates to greatly reduce the running cost. Through the measurement of a probe, an accurate roll gap is obtained between an upper roll and a lower roll, thereby significantly increasing the rolling precision, achieving a very stable rolling effect, and effectively ensuring the quality of roll die sheets, upper rolling plates and lower rolling plates.

Generally, after core-drawing of a hole of a cast, an axial core-drawing tilt often exists. For a bearing hole having a high assembly precision, after casting forming, shearing process is further required. In the foregoing embodiment of the present invention, the left frame 100 includes the left front support 110 and the left rear support 120 along the center of the bearing hole. The right frame 100*a* includes the right front support 110*a* and the right rear support 120*a* along the center of the bearing hole, and the formation is achieved by adopting a forming method of casting along a bearing aperture, which eliminates the axial taper of a bearing hole, and also solves the axial positioning of the bearing and the sliding block along the roll on the frame, thereby omitting a stop ring required by axial positioning of a bearing and a guide pressing plate required by axial positioning of a sliding block. Further, the through holes for screws required for the assembly of the frame can be cast one by one. A core-drawing structure is omitted in a casting mold, thereby reduce the fabrication cost for casting molds, which reduces shearing process for metal, reduces the number of parts to form, and reduces the production cost.

What is claimed is:

1. A decorative material rolling mill having an adjustable roll gap, comprising:

a left frame and a right frame connected to each other;

an upper roll and a lower roll, two ends thereof being axially disposed on the left frame and the right frame; and a driving mechanism for driving the upper roll and the lower roll to rotate; and a rolling gap adjustment mechanism for driving the upper roll or the lower roll to move vertically along the left frame and the right frame, thereby adjusting a rolling gap between the upper roll and the lower roll according to the thickness of a shearing die, said shearing die comprising an upper rolling plate, a lower rolling plate and a die sheet, wherein the two ends of the upper roll or the lower roll are disposed on the left frame and the right frame through sliding blocks, and the rolling gap adjustment mechanism drives the sliding blocks to move vertically along the left frame and the right frame, to drive said upper roll and lower roll to move upward and downward, in order to adjust the gap between said upper roll and said lower roll, wherein the rolling gap adjustment mechanism comprises:

slope block protruding openings arranged at upper portions or lower portions of the left frame and the right frame;

passive slopes arranged at top portions or bottom portions of the sliding blocks at the two ends of the upper roll or the lower roll;

a guide rail plate connected between top portions or bottom portions of the left frame and the right frame;

a dual-joint slope block arranged on a bottom surface or a top surface of the guide rail plate and horizontally movable along the guide rail plate, two ends of the dual-joint slope block protruding from the slope block protruding openings at the upper portions or the lower portions of the left frame and the right frame;

active slopes fitting the passive slopes at the top portions or the bottom portions of the sliding blocks at the two ends of the upper roll or the lower roll being arranged on bottom surfaces or top surfaces of two ends of the dual-joint slope block, wherein the dual-joint slope block and the guide rail plate form a first movement set, and the active slopes and the passive slopes form second movement sets, and a movement handle arranged on the dual-joint slope block;

wherein a guide rail groove is arranged on the guide rail plate along the length direction of the guide rail plate;

a sliding key and a pair of trench plates are arranged inside the guide rail groove, the sliding key is connected to the dual-joint slope block, the pair of trench plates is arranged at two sides of the sliding key.

2. The decorative material rolling mill having an adjustable roll gap according to claim 1, wherein the driving mechanism comprises a driving small gear axially disposed on the left frame or the right frame through a driving handle shaft, a large gear located at the same side as the driving small gear and axially disposed on a shaft end at one side of the upper roll or the lower roll, and a transmission gear set axially disposed on a shaft end at any side of the upper roll and the lower roll; and a crank handle is arranged on the driving handle shaft.

3. The decorative material rolling mill having an adjustable roll gap according to claim 2, wherein a radial positioning hole is provided on the sliding key, a pair of positioning steel balls and a positioning spring are arranged inside the radial positioning hole, the positioning spring is arranged between the pair of steel balls; several positioning trenches or positioning holes are provided at an interval on one trench plate, and one positioning steel ball is pressed inside one random positioning trench or positioning hole under the effect of the positioning spring, so as to position the dual-joint slope block.

4. The decorative material rolling mill having an adjustable roll gap according to claim 2, wherein horizontal stops are disposed at middle portions of the left frame and the right frame, sliding block reset springs are disposed between bottom surfaces or top surfaces of the sliding blocks and the horizontal stops.

5. The decorative material rolling mill having an adjustable roll gap according to claim 2, wherein the active slopes and the passive slopes are both stepped slopes.

6. The decorative material rolling mill having an adjustable roll gap according to claim 2, wherein the active slopes and the passive slopes are connected in a slideable manner by adopting a structure of a T-shaped groove and a T-shaped guide rail being inserted to each other.

7. The decorative material rolling mill having an adjustable roll gap according to claim 6, wherein a screw hole is provided at a left end or a right end of the dual-joint slope block, a bolt support portion is disposed on the left frame or the right frame, a radially rotatable but axially-constrained screw rod is arranged on the bolt support portion, and the screw rod is screwed inside the screw hole.

8. The decorative material rolling mill having an adjustable roll gap according to claim 2, wherein the rolling gap adjustment mechanism comprises:

a pair of cams disposed inside upper portions or lower portions of the left frame and the right frame, the pair of cams contacting top portions or the bottom portions of the sliding blocks at the two ends of the upper roll or the lower roll;

a cam shaft connecting the pair of cams, the cam shaft being axially supported on the left frame or the right frame and extending from the left frame or the right frame;

a crank handle arranged on a shaft end of the cam shaft extending from the left frame or the right frame; and horizontal stops disposed at middle portions of the left frame and the right frame, sliding block reset springs being disposed between bottom surfaces or top surfaces of the sliding blocks and the horizontal stops.

9. The decorative material rolling mill having an adjustable roll gap according to claim 2, wherein the rolling gap adjustment mechanism comprises:

screw holes arranged inside the sliding blocks at the two ends of the upper roll or the lower roll;

a screw rod screwed in each screw hole, a worm gear being arranged in each screw rod;

a dual-joint worm axially disposed on the left frame and the right frame, worm segments being synchronously engaged with two worm gears being disposed on the dual-joint worm;

one end of the dual-joint worm extending from the left frame or the right frame; and a crank handle arranged on a shaft end of the dual-joint worm extending from the left frame or the right frame.

10. The decorative material rolling mill having an adjustable roll gap according to claim 2, wherein the rolling gap adjustment mechanism comprises:

frame slopes arranged inside top portions of the left frame and the right frame;

upper connecting plates fixed on the top portions of the left frame and the right frame;

positioning guide rails fixed at middle positions of the upper connecting plates, inclined angles of the positioning guide rails being consistent with angles of the frame slopes;

guide rail cover plates fixed at two ends of the positioning guide rails;

a dual-joint slope block, two ends of the dual-joint slope block extending between top surfaces of the sliding blocks at the two ends of the upper roll and the frame slopes, passive slopes fitting the frame slopes being arranged at top portions of the two ends of the dual-joint slope block, the frame slopes and the passive slopes forming movement sets, sliding block acting portions being arranged at bottom portions of two ends of the dual-joint slope block, and the sliding block acting portions acting on the sliding blocks;

a positioning sliding block inserted inside the positioning guide rails being fixedly disposed at a middle position of the dual-joint slope block, one end of the positioning sliding block coming out from one guide rail cover plate, and a positioning guide rail reset spring being arranged between the other end of the positioning sliding block and the other guide rail cover plate; and a probe installed on the part of the positioning sliding block coming out from the guide rail cover plate through a radial fixation screw and an axial adjustment screw, the probe being located above a rolling workbench.

11. The decorative material rolling mill having an adjustable roll gap according to claim 2, wherein the left frame is formed of a left front support and a left rear support, and the right frame is formed of a right front support and a right rear support.

12. The decorative material rolling mill having an adjustable roll gap according to claim 11, wherein the left front support, the left rear support, the right front support, and the right rear support are formed by adopting a casting forming method along an aperture.

13. The decorative material rolling mill having an adjustable roll gap according to claim 2, wherein the left frame is formed of a left front support and a left rear support, and the right frame is formed of a right front support and a right rear support.

14. The decorative material rolling mill having an adjustable roll gap according to claim 3, wherein the left frame is formed of a left front support and a left rear support, and the right frame is formed of a right front support and a right rear support.

15. The decorative material rolling mill having an adjustable roll gap according to claim 4, wherein the left frame is formed of a left front support and a left rear support, and the right frame is formed of a right front support and a right rear support.

16. The decorative material rolling mill having an adjustable roll gap according to claim 5, wherein the left frame is formed of a left front support and a left rear support, and the right frame is formed of a right front support and a right rear support.

17. The decorative material rolling mill having an adjustable roll gap according to claim 6, wherein the left frame is formed of a left front support and a left rear support, and the right frame is formed of a right front support and a right rear support.

* * * * *